US011390063B1

(12) United States Patent
Biegelsen

(10) Patent No.: US 11,390,063 B1
(45) Date of Patent: Jul. 19, 2022

(54) SOLID FOG DEVELOPMENT FOR DIGITAL OFFSET PRINTING APPLICATIONS

(71) Applicant: Palo Alto Research Center Incorporated, Palo Alto, CA (US)

(72) Inventor: David K. Biegelsen, Portola Valley, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 17/152,630

(22) Filed: Jan. 19, 2021

(51) Int. Cl.

| | |
|---|---|
| ***B41F 7/26*** | (2006.01) |
| ***G03G 15/10*** | (2006.01) |
| ***B41C 1/10*** | (2006.01) |
| ***G03G 21/00*** | (2006.01) |
| ***G03G 15/26*** | (2006.01) |
| ***G03G 15/02*** | (2006.01) |

(52) U.S. Cl.
CPC ..... *B41F 7/26* (2013.01); *B41C 1/1041* (2013.01); *B41C 1/1058* (2013.01); *G03G 15/0208* (2013.01); *G03G 15/101* (2013.01); *G03G 15/104* (2013.01); *G03G 15/266* (2013.01); *G03G 21/0088* (2013.01)

(58) Field of Classification Search
CPC ..... B41F 7/24; B41F 7/26; B41F 7/37
See application file for complete search history.

(56) References Cited

U.S. PATENT DOCUMENTS

| | | | |
|---|---|---|---|
| 2,551,582 | A | 5/1951 | Carlson |
| 8,958,723 | B2 | 2/2015 | Liu |
| 9,316,993 | B2 | 4/2016 | Veres et al. |
| 10,744,754 | B2 | 8/2020 | Williams et al. |
| 2013/0033686 | A1 | 2/2013 | Stowe et al. |
| 2014/0013980 | A1 | 1/2014 | Veres et al. |
| 2014/0261030 | A1 * | 9/2014 | Liu ..... B41F 7/24 101/147 |
| 2017/0217150 | A1 | 8/2017 | Moore et al. |

OTHER PUBLICATIONS

Co-Pending U.S. Appl. No. 17/152,597, filed Jan. 19, 2021.
Co-Pending U.S. Appl. No. 17/152,538, filed Jan. 19, 2021.
Co-Pending U.S. Appl. No. 17/152,574, filed Jan. 19, 2021.
European Search Report to related European Patent Application No. 19185256.5 dated Jan. 13, 2020.

* cited by examiner

*Primary Examiner* — Walter L Lindsay, Jr.
*Assistant Examiner* — Andrew V Do
(74) *Attorney, Agent, or Firm* — Caesar Rivise, PC

(57) ABSTRACT

A solid particle aerosol development device form fogs of solid (e.g., frozen) fountain solution particles that are charged, and brings the charged solid fountain solution particles into proximity of an electrostatic charged image pattern on a imaging member's charge retentive surface. The charged solid fountain solution particles bond to the charge retentive surface at the charged image pattern to develop that image into a fountain solution latent image. The solid particle aerosol development devices produce solid fountain solution particles to develop electrostatic latent images while mitigating issues of evaporation and vapor production, and thus may apply fine films of fountain solution which may otherwise evaporate. In examples, the fountain solution aerosol development devices may include an anilox member, a metering member in contact with the anilox member, a fountain solution reservoir, a particle charger and a particle delivery baffle.

20 Claims, 6 Drawing Sheets

SOLID FOG DEVELOPMENT FOR DIGITAL OFFSET PRINTING APPLICATIONS

FIELD OF DISCLOSURE

The present disclosure is related to marking and printing systems, and more specifically to variable data lithography system using fog development of an electrographic image for creating a fountain solution image.

BACKGROUND

Offset lithography is a common method of printing today. For the purpose hereof, the terms "printing" and "marking" are interchangeable. In a typical lithographic process a printing plate, which may be a flat plate, the surface of a cylinder, belt and the like, is formed to have image regions formed of hydrophobic and oleophilic material, and non-image regions formed of a hydrophilic material. The image regions are regions corresponding to areas on a final print (i.e., the target substrate) that are occupied by a printing or a marking material such as ink, whereas the non-image regions are regions corresponding to areas on the final print that are not occupied by the marking material.

Digital printing is generally understood to refer to systems and methods of variable data lithography, in which images may be varied among consecutively printed images or pages. "Variable data lithography printing," or "ink-based digital printing," or "digital offset printing" are terms generally referring to printing of variable image data for producing images on a plurality of image receiving media substrates, the images being changeable with each subsequent rendering of an image on an image receiving media substrate in an image forming process. "Variable data lithographic printing" includes offset printing of ink images generally using specially-formulated lithographic inks, the images being based on digital image data that may vary from image to image, such as, for example, between cycles of an imaging member having a reimageable surface. Examples are disclosed in U.S. Patent Application Publication No. 2012/0103212 A1 (the '212 Publication) published May 3, 2012 based on U.S. patent application Ser. No. 13/095,714, and U.S. Patent Application Publication No. 2012/0103221 A1 (the '221 Publication) also published May 3, 2012 based on U.S. patent application Ser. No. 13/095,778.

A variable data lithography (also referred to as digital lithography) printing process usually begins with a fountain solution used to dampen a silicone imaging plate or blanket on an imaging drum. The fountain solution forms a film on the silicone plate that is on the order of about one (1) micron thick. The drum rotates to an exposure station where a high-power laser imager is used to remove the fountain solution at locations where image pixels are to be formed. This forms a fountain solution based latent image. The drum then further rotates to an inking station where lithographic-like ink is brought into contact with the fountain solution based latent image and ink transfers into places where the laser has removed the fountain solution. The ink is usually hydrophobic for better adhesion on the plate and substrate. An ultraviolet (UV) light may be applied so that photo-initiators in the ink may partially cure the ink to prepare it for high efficiency transfer to a print media such as paper. The drum then rotates to a transfer station where the ink is transferred to a print substrate such as paper. The silicone plate is compliant, so an offset blanket is not needed to aid transfer. UV light may be applied to the paper with ink to fully cure the ink on the paper. The ink is on the order of one (1) micron pile height on the paper.

The formation of the image on the printing plate/blanket is usually done with imaging modules each using a linear output high power infrared (IR) laser to illuminate a digital light projector (DLP) multi-mirror array, also referred to as the "DMD" (Digital Micromirror Device). The laser provides constant illumination to the mirror array. The mirror array deflects individual mirrors to form the pixels on the image plane to pixel-wise evaporate the fountain solution on the silicone plate to create the fountain solution latent image.

Due to the need to evaporate the fountain solution to form the latent image, power consumption of the laser accounts for the majority of total power consumption of the whole system. The laser power that is required to create the digital pattern on the imaging drum via thermal evaporation of the fountain solution to create a latent image is particularly demanding (30 mW per 20 um pixel, ~500 W in total). The high power laser module adds a significant cost to the system; it also limits the achievable print speed to about five meters per second (5 m/s) and may compromise the lifetime of the exposed components (e.g., micro-mirror array, imaging blanket, plate, or drum).

For the reasons stated above, and for other reasons which will become apparent to those skilled in the art upon reading and understanding the present specification, it would be beneficial to increase speed and lower power consumption in variable data lithography systems while improving fountain solution deposition.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a charged fountain solution particle development device useful for printing with an ink-based digital image forming apparatus having a rotatable imaging member with a charge-retentive surface bearing an electrostatic charged pattern and a rotatable inkable blanket downstream the imaging member and having a surface in rolling communication with the charge-retentive surface. The rotatable inkable blanket is configured to accept a patterned fountain solution latent image and transfer an ink image based on the patterned fountain solution latent image. The exemplary charged fountain solution particle development device includes an anilox member, a fountain solution reservoir, a metering member and a particle charger. The anilox member has a textured surface layer with dimples configured to receive and carry fountain solution for transfer to the charge-retentive surface. The fountain solution reservoir is in physical communication with the anilox member to store and supply the fountain solution to the dimples of the anilox member. The metering member may be in contact with the anilox member at a nip therebetween, with, the metering member configured to remove excess fountain solution from the textured surface layer of the anilox member resulting in a metered layer of fountain solution. The textured surface layer may be chilled to below a freezing temperature of the fountain solution to freeze the metered layer of fountain solution into solid fountain solution particles. The particle charger converts the fountain solution of the metered layer into charged solid particles. The charged solid particles are released from the anilox member proximate the rotatable imaging member charge-retentive surface and are attracted to the electrostatic charged pattern to attach to the charge-retentive surface and form the patterned fountain solution latent image based on the electrostatic charged patterned.

According to aspects described herein, a fountain solution particle development device is described for delivering charged fountain solution particles onto a target having a charge-retentive surface bearing an electrostatic charged pattern thereon. The development device may include: an anilox member having a textured surface layer with dimples configured to receive and carry fountain solution for transfer to the charge-retentive surface; a fountain solution reservoir in liquid communication with the anilox member to supply the fountain solution to the textured dimples of the anilox member; a metering member in contact with the anilox member, the metering member configured to remove excess fountain solution from the textured surface layer of the anilox member resulting in a metered layer of fountain solution on the textured surface layer; a cooler proximate to the textured surface layer, the cooler configured to chill the textured surface layer to below a freezing temperature of the fountain solution to freeze the metered layer of fountain solution into solid fountain solution particles; and a particle charger adjacent the anilox member that drives a flux of ions through the solid fountain solution particles to form charged solid particles, wherein the charged solid particles are released from the anilox member proximate the target and are attracted to the electrostatic charged pattern to attach to the charge-retentive surface and form a patterned fountain solution latent image.

According to aspects illustrated herein, an exemplary method for delivering charged solid fountain solution particles onto a target having a charge-retentive surface bearing an electrostatic charged pattern thereon includes supplying fountain solution to a textured surface layer of an anilox member, with the textured surface layer having dimples configured to receive and carry fountain solution, removing excess fountain solution from the textured surface layer of the anilox member resulting in a metered layer of fountain solution on the textured surface layer with a metering member in contact with the anilox member, freezing the metered layer of fountain solution into solid fountain solution particles by chilling the textured surface layer to below a freezing temperature of the fountain solution, changing the fountain solution of the metered layer into charged solid particles via a particle charger adjacent the anilox member, and releasing the charged solid particles from the anilox member proximate the target for attachment to the charge-retentive surface to form a patterned fountain solution latent image based on the electrostatic charged patterned.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION OF THE INVENTION

Figure 1:
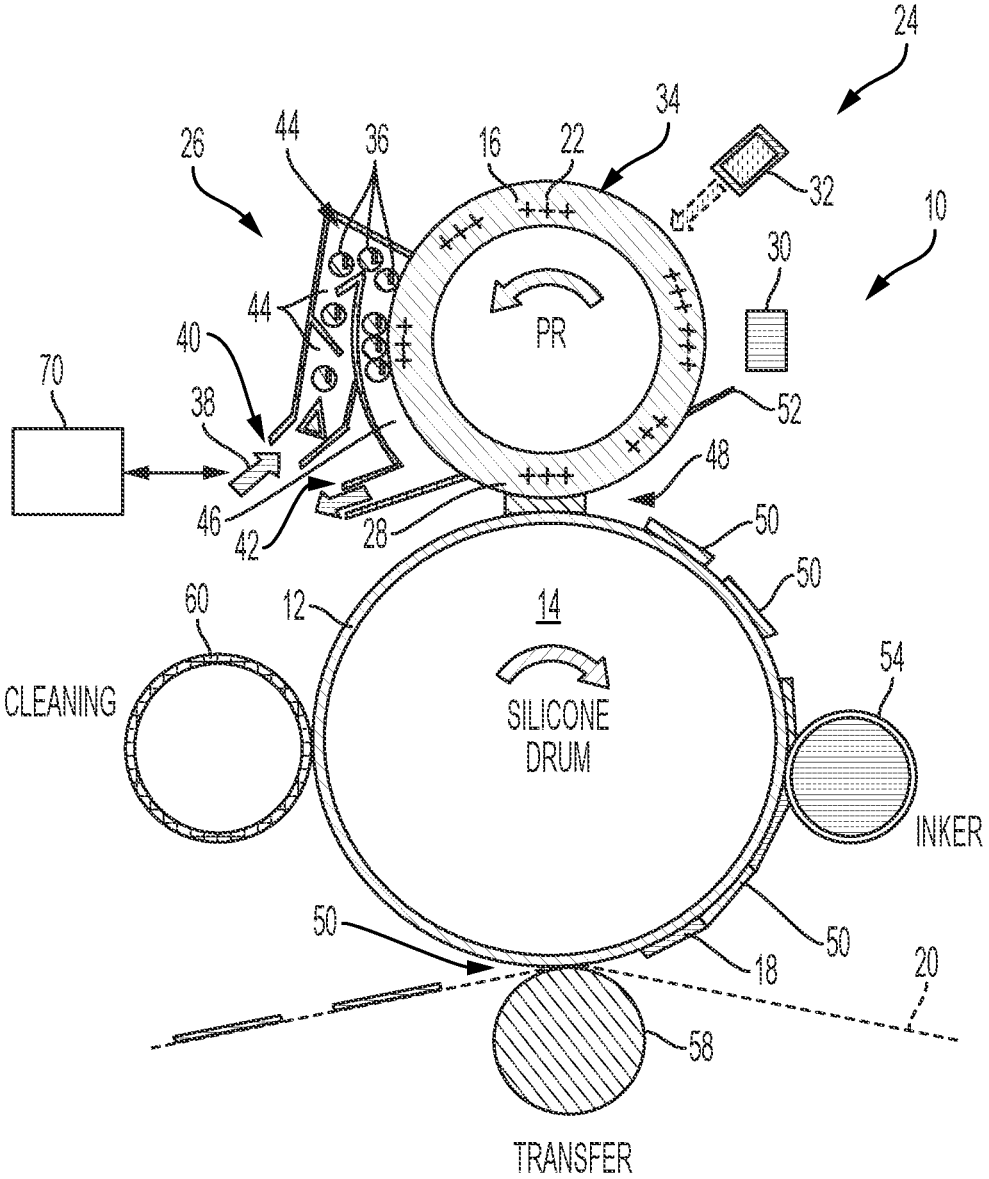
FIG. 1 RELATED ART
FIG. 1 illustrates a diagram of a related art ink-based digital printing system.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatus, and systems for inking from an inking member to the reimageable surface of a digital imaging member.

When referring to any numerical range of values herein, such ranges are understood to include each and every number and/or fraction between the stated range minimum and maximum. For example, a range of 0.5-6% would expressly include the endpoints 0.5% and 6%, plus all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The term "controller" or "control system" is used herein generally to describe various apparatus such as a computing device relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

The terms "media", "print media", "print substrate" and "print sheet" generally refers to a usually flexible physical sheet of paper, polymer, Mylar material, plastic, or other suitable physical print media substrate, sheets, webs, etc., for images, whether precut or web fed. The listed terms "media", "print media", "print substrate" and "print sheet" may also include woven fabrics, non-woven fabrics, metal films, and foils, as readily understood by a skilled artisan.

The term "image forming device", "printing device" or "printing system" as used herein may refer to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

The term "fountain solution" or "dampening fluid" refers to dampening fluid that may coat or cover a surface of a structure (e.g., imaging member, transfer roll) of an image forming device to affect connection of a marking material (e.g., ink, toner, pigmented or dyed particles or fluid) to the surface. The fountain solution may include water optionally with small amounts of additives (e.g., isopropyl alcohol, ethanol) added to reduce surface tension as well as to lower evaporation energy necessary to support subsequent laser patterning. Low surface energy solvents, for example volatile silicone oils, can also serve as fountain solutions. Fountain solutions may also include wetting surfactants, such as silicone glycol copolymers. The fountain solution may be non-aqueous including, for example, silicone fluids (such as D3, D4, D5, OS10, OS20, OS30 and the like), Isopar fluids, and polyfluorinated ether or fluorinated silicone fluid. The term fountain solution used herein may refer to a liquid, solid or vapor phase of such materials.

The term "aerosol" refers to a suspension of solid and/or liquid particles in a gas. An aerosol may include both the particles and the suspending gas, which may be air, another gas or mixture thereof. The solids and/or liquid particles are sufficiently large for sedimentation, for example, as fountain solution on an imaging member surface. For example, solid or liquid particles may be greater than 0.1 micron, less than 5 microns, between about 0.5 and 2 microns and about 1 micron in diameter.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of stations" may include two or more stations. The terms "first," "second," and the like, herein do not denote any order, quantity, or importance, but rather are used to distinguish one element from another. The terms "a" and "an" herein do not denote a limitation of quantity, but rather denote the presence of at least one of the referenced item.

FIG. 1 depicts an exemplary related art ink-based digital image forming apparatus 10 for variable data lithography including fog development of a charged fountain solution aerosol that forms a latent digital image created electrographically. The latent digital image is transferred to an inking blanket 12 of a transfer member 14 (e.g., roller, cylinder, drum) downstream an imaging member 16 for subsequent printing of an associated ink image 18 onto a print substrate 20. The imaging member 16 shown in FIG. 1 is a drum, but this exemplary depiction should not be read in a manner that precludes the imaging member 16 being a blanket, a belt, or of another known configuration. The image forming apparatus 10 includes the rotatable imaging member 16 having an arbitrarily reimageable surface 22 as different images can be created on the surface layer. In examples, the surface 22 is a charge-retentive surface such as but not limited to a photoreceptor surface or a dielectric surface. The reimageable charge-retentive surface 22 may be part of the drum or formed over a structural mounting layer that may be, for example, a cylindrical core, or one or more structural layers over a cylindrical core. The reimageable charge-retentive surface may be formed of a relatively thin layer over the mounting layer, a thickness of the relatively thin layer being selected to balance charge retaining performance, durability and manufacturability. The imaging member 16 is surrounded by an imaging station 24 configured to form an electrostatic charged pattern of a latent image on the imaging member surface 22, and an aerosol development device 26 that provides a fog of charged fountain solution aerosol particles that are attracted to the electrostatic charged pattern.

According to examples, fountain solution latent images 28 are created (e.g., xerographically, ionographically) on imaging member 16 and transferred to the inking blanket 12 for further processing. At the imaging station 24, a charging device 30 charges the imaging member surface 22, for example by corona discharge from a high voltage power source via a conductor of the charging device adjacent the charge-retentive imaging member surface 22. In electrography or xerography an imager 32 having a low power light source (e.g., a laser with a conventional ROS scanner, LED bar) selectively discharges select portions or pixels of the surface 22 according to image data to generate an electrostatic charged pattern 34 disposed on the surface of the imaging member 20. In ionography the imager 32 includes an image projection head for projecting ion beams, i.e., ions of a given polarity, onto the charge-retentive surface 22 after the surface is charged by the charging device 30. The surface 22 shown could be a photoreceptor, but when the application is ionographically created, an insulating surface could be used to create the charge image.

The aerosol development device 26 presents a charged patterned uniform layer of fountain solution (e.g., silicone fluids, such as D4, D5, Isopar G, Isopar H, Dowsil OS20, Dowsil OS30, L5; water/IPA mixtures, hydrophilic fluids, and mixtures thereof) aerosol particles 36 in solid or liquid particle form onto the surface 22 of the imaging member 16. The fountain solution aerosol particles 36 are configured to adhere to portions of the imaging member surface 22 according to the electrostatic charged pattern 34 developed thereon by imager 32. In examples, charged fountain solution aerosol particles 36 of opposite polarity of the imaging member surface 22 are deposited onto the electrostatic charged pattern 34, forming a fountain solution latent image 28 on the imaging member surface. In other examples, charged fountain solution aerosol particles 36 of the same polarity as the imaging member surface 22 would be deposited on the neutral pixels thereof.

The aerosol development device 26 atomizes and charges fountain solution 38 into charged fountain solution aerosol particles 36 that enter an inlet port 40. In examples, a pump may supply fountain solution from a container housing the fountain solution to an aerosol generator (e.g., a nebulizer) at a steady, controlled rate. The fountain solution may contain charge control agents (e.g., surfactants, polymer solution, salts), to assist particle charging, as well understood by a skilled artisan. The aerosol development device 26 further includes a manifold having walls 62 defining a chamber 44 and a radially enlarged region 46 near the imaging member surface 22 where a fog of charged fountain solution aerosol particles 36 may carry the atomized fountain solution to the electrostatic charged pattern 34 on the surface of imaging member 16.

A carrier gas such as nitrogen, added in a predetermined amount, may be introduced into the developer unit chamber 44 via inlet port 40 to carry the atomized fountain solution aerosol particles 36 to the surface 22 of imaging member 16 as a gas mixture, where they may be attracted to the electrostatic charged pattern 34 and bond to the charge-retentive reimageable surface 22 and form a fountain solution latent image 28. The gas mixture transporting the atomized fountain solution aerosol particles includes the carrier gas and a controlled partial pressure of fountain solution. This partial pressure of fountain solution may solely originate from evaporated fountain solution or a controlled additional vaporized fountain solution. An increase in the partial pressure of the fountain solution will slow down the evaporation from the fountain solution droplets. The partial pressure may be modified, for example, by the controller adding vaporized fountain solution to the gas mixture, as well understood by a skilled artisan.

The surface charge density (created by charging device 30) of the latent image attracts a volume of fountain solution aerosol particles 36 until the surface charge is optionally neutralized or partially neutralized by the fog charged aerosol. Adhesion forces with the imaging member 16 and each other will cause the aerosol particles to remain on the surface 22 of the imaging member.

Aerosol particles 36 do not bond to the surface 22 of imaging member 16 where no latent image charge resides. The aerosol particles 36 can also be electrostatically repelled from uncharged regions of the electrostatic charged pattern 34, for example, via voltage applied to walls of the development device 26. Aerosol particles 36 that do not bond to the imaging member surface 22 may exit the developer unit 20 via outlet port 42 and flow back to the fountain solution container. A vapor vacuum or air knife (not shown) may be positioned adjacent the downstream side of the radially enlarged region 46 near the outlet port 42 to collect unattached aerosol particles and thus avoid leakage of fountain solution into the environment. Reclaimed fountain solution particles can also be condensed and filtered as needed for reuse as understood by a skilled artisan to help minimize the overall use of fountain solution by the image forming device 10.

The transfer member 14 may be configured to form a fountain solution image transfer nip 48 with the imaging member 16. A fountain solution image produced by the developer unit 26 and imaging station 24 on the surface 22 of the imaging member 16 is transferred to the inking blanket 12 of the transfer member 14 under pressure at the loading nip 48. In particular, a light pressure (e.g., a few pounds, greater than 0.1 lbs., less than 10 lbs., about 1-4 lbs.) may be applied between the surface of the inking blanket 12 and the imaging member surface 22. At the fountain solution transfer nip 48, the fountain solution latent image 28 splits as it leaves the nip, and transfers a split layer of the fountain solution latent image, referred to as the transferred fountain solution latent image 50, to the transfer member surface (i.e., inking blanket 12). The amount of fountain solution transferred may be adjusted by contact pressure adjustments of nip 48. For example, a split fountain solution latent image 50 of about one (1) micrometer or less may be transferred to the inking blanket surface. Like the imaging member 16, the transfer member 14 may be electrically biased to enhance loading of the dampening fluid latent image at the loading nip 48.

After transfer of the fountain solution latent image from the imaging member 16, the imaging member 16 may be cleaned in preparation for a new cycle by removing dampening fluid and solid particles from the surface at a cleaning station 52. Various methods for cleaning the imaging member surface 22 may be used, for example an air knife and/or sponge, as well understood by a skilled artisan.

After the fountain solution latent image 50 is transferred to the transfer member 14, ink from an inker 54 is applied to the inking blanket 12 to form an ink pattern or image 18. The inker 54 is positioned downstream fountain solution transfer nip 48 to apply a uniform layer of ink over the transferred fountain solution latent image 50 and the inking blanket 12. While not being limited to a particular theory, the ink pattern or image 18 may be a negative of or may correspond to the fountain solution pattern. For example, the inker 54 may deposit the ink to the evaporated pattern representing the imaged portions of the reimageable surface 26, while ink deposited on the unformatted portions of the fountain solution will not adhere based on a hydrophobic and/or oleophobic nature of those portions. The ink image 18 may be transferred to print media or substrate 20 at an ink image transfer nip 56 formed by the transfer member 14 and a substrate transport roll 58. The substrate transport roll 58 may urge the print substrate 20 against the transfer member surface, or inking blanket 12, to facilitate contact transfer of the ink image 18 from the transfer member 14 to the print substrate.

After transfer of the ink image 18 from the transfer member 14 to the print media 20, residual ink may be removed by a cleaning device 60. This residual ink removal is most preferably undertaken without scraping or wearing the imageable surface of the imaging blanket 12. Removal of such remaining fluid residue may be accomplished through use of some form of cleaning device 60 adjacent the imaging blanket 12 between the ink image transfer nip 56 and the fountain solution transfer nip 48. Such a cleaning device 20 may include at least a first cleaning member such as a sticky or tacky roller in physical contact with the imaging blanket surface, with the sticky or tacky roller removing residual fluid materials (e.g., ink, fountain solution) from the surface. The sticky or tacky roller may then be brought into contact with a smooth roller (not shown) to which the residual fluids may be transferred from the sticky or tacky member, the fluids being subsequently stripped from the smooth roller by, for example, a doctor blade or other like device and collected as waste.

It is understood that the cleaning device 60 is one of numerous types of cleaning devices and that other cleaning devices designed to remove residual ink/fountain solution from the surface of imaging blanket 12 are considered within the scope of the embodiments. For example, the cleaning device could include at least one roller, brush, web, belt, tacky roller, buffing wheel, etc., as well understood by a skilled artisan. It is also understood that the cleaning device 60 may be more sophisticated or aggressive at removing residual fluids from imaging blanket 12 that the cleaning station 52 is at removing fountain solution from the surface 22 of the imaging member 16. Cleaning station 52 is not concerned with removing residual ink, and merely is designed to remove fountain solution and associated contaminates from the surface 22.

The exemplary ink-based digital image forming devices and operations thereof may be controlled by a controller 70 in communication with the image forming devices and parts thereof. For example, the controller 70 may control the imaging station 24 to create electrostatic charged patterns of latent images on the imaging member surface 22. Further, the controller 70 may control the aerosol development device 26 or other aerosol development devices discussed in greater detail below to provides the fog of charged fountain solution aerosol particles that are attracted to the electrostatic charged pattern. The controller 70 may be embodied within devices such as a desktop computer, a laptop computer, a handheld computer, an embedded processor, a handheld communication device, or another type of computing device, or the like. The controller 70 may include a memory, a processor, input/output devices, a display and a bus. The bus may permit communication and transfer of signals among the components of the controller 70 or computing device, as will be described in greater detail below.

Figure 2:
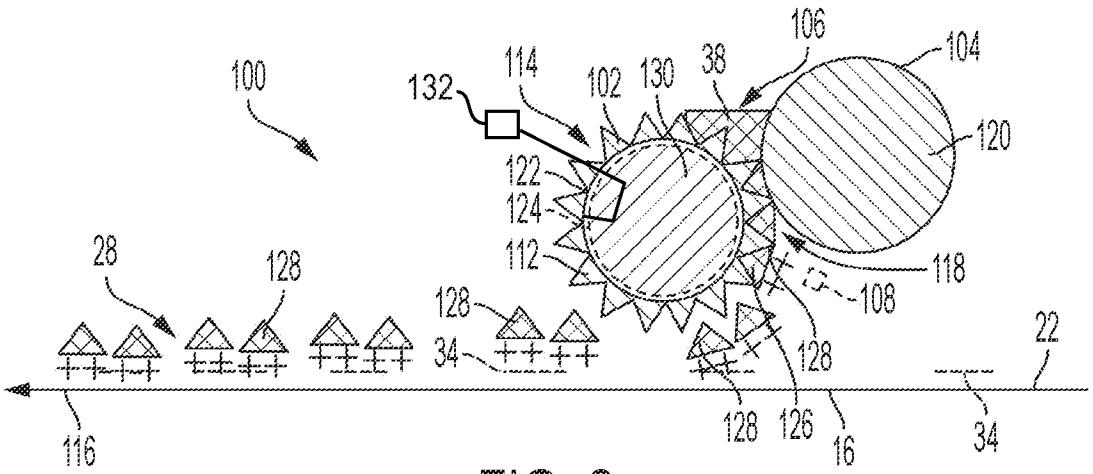
FIG. 2 is a side view partially in cross of a fountain solution solid particle aerosol development device in accordance with examples of the embodiments.
Figure 3:
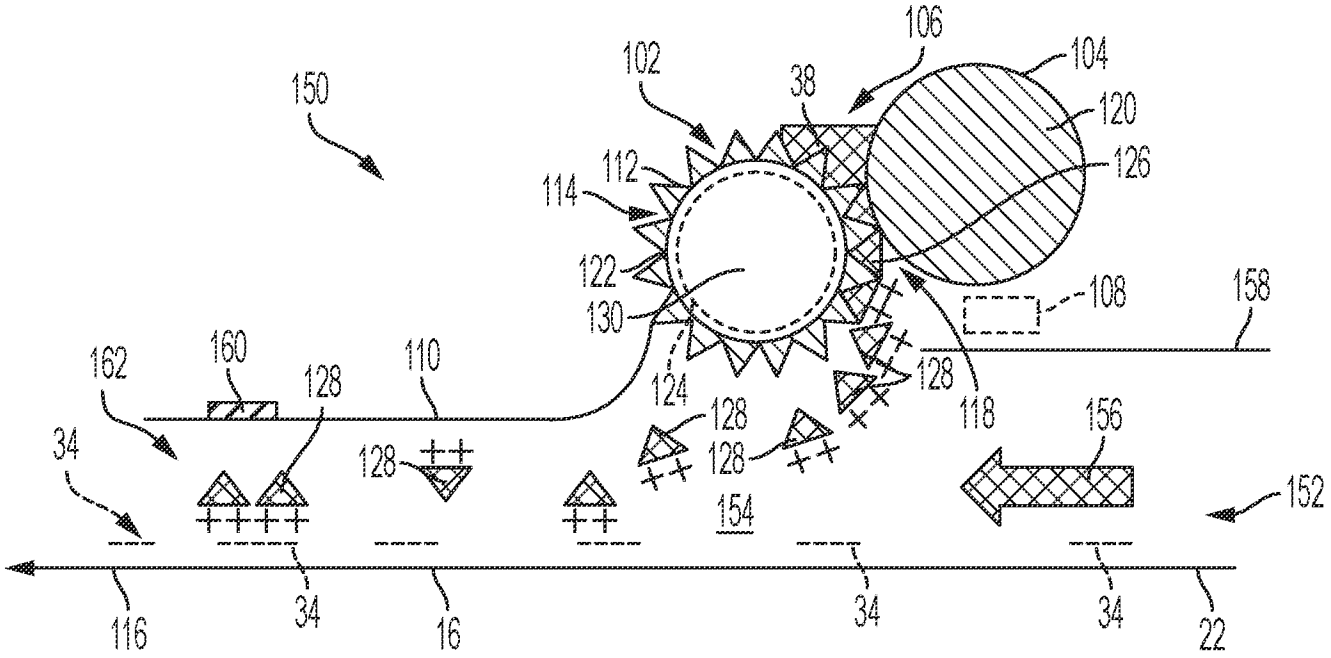
FIG. 3 is a side view partially in cross of another fountain solution solid particle aerosol development device in accordance with examples of the embodiments.
Figure 4:
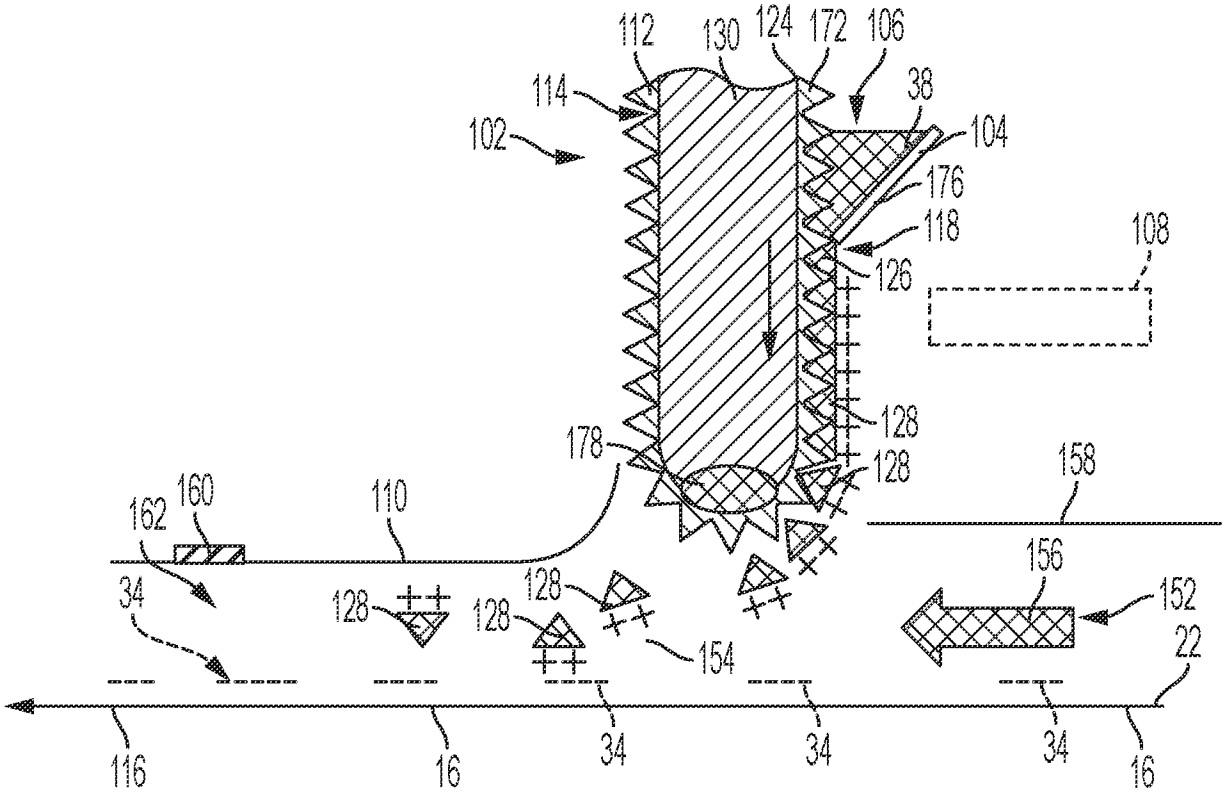
FIG. 4 is a side view partially in cross of yet another fountain solution solid particle aerosol development device in accordance with examples of the embodiments.

FIGS. 2-4 depict exemplary solid particle aerosol development devices in accordance with examples of the embodiments. The solid particle aerosol development devices are similar to the aerosol development device 26 discussed above. For example, the fountain solution aerosol development devices present a charged patterned layer of fountain solution (e.g., silicone fluids, such as D4, D5, Isopar G, Isopar H, Dowsil OS20, Dowsil OS30, L5; water/IPA mixtures, hydrophilic fluids, and mixtures thereof) in aerosol (i.e., solid or liquid) particle form onto surface 22 of imaging member 16. The fountain solution aerosol particles 36 adhere to portions of the imaging member surface 22 according to the electrostatic charged pattern 34 developed thereon by imager 32. Accordingly the aerosol development device 26 may be replaced by the solid particle aerosol development devices, and may associate with the imaging member 16 and controller 70 in similar manner.

The solid particle aerosol development devices are charged fountain solution aerosol solid particle development devices useful for printing with the ink-based digital image forming device 10 (FIG. 1) having rotatable imaging member 16 with a charge-retentive reimageable surface 22 bearing an electrostatic charged pattern 34 and a rotatable inking blanket 12 downstream the imaging member. The rotatable inking blanket 12 (or belt) has a surface in rolling communication with the charge-retentive surface 22 and may be conformable to accept the charged patterned fountain solution latent image 28 and transfer an ink image 18 corresponding to the electrostatic charged pattern 34 to a substrate 20. The inking blanket 12 may include, for example, hydrophobic polymers such as silicones, partially or fully fluorinated fluorosilicones and FKM fluoroelastomers. Other materials may be employed, including blends of polyurethanes, fluorocarbons, polymer catalysts, platinum catalyst, hydrosilyation catalyst, etc. The surface may be configured to conform to a print substrate on which an ink image is printed. To provide effective wetting of fountain solutions such as water-based dampening fluid, the silicone surface need not be hydrophilic, but may be hydrophobic. The inking blanket 12 may have high electrical resistivity and finite conductivity to avoid charge buildup on the blanket.

While not being limited to a particular theory, the solid particle aerosol development devices form fogs of solid (e.g., frozen) fountain solution particles that are charged, with the frozen solid fountain solution particles having roughly the same C/M, and brings the charged solid fountain solution particles into proximity of an electrostatic charged image pattern 34 on the charge retentive surface 22. The solid particle aerosol development devices produce solid fountain solution particles to develop electrostatic latent images while mitigating issues of evaporation and vapor production, and thus may apply fine films of fountain solution which may otherwise evaporate. The charged solid fountain solution particles bond to the surface 22 at the charged image pattern to develop that image into a fountain solution latent image. In examples, the fountain solution aerosol development devices may include an anilox member 102, a metering member 104 in contact with the anilox member, a fountain solution reservoir 106, a particle charger 108 and a particle delivery baffle 110, as will be described in greater detail below.

The term anilox member refers to a textured roll having a pitted or textured surface layer with dimples or anilox cells in the surface. The anilox member may be cylindrical, ellipsoidal, elliptical cylindrical, oblong cylindrical, spherical, oval cylindrical, parabolic cylindrical, hyperbolic cylindrical or any combination thereof. The anilox member may be similar in appearance to an anilox roll, but its surface is not limited by hardness (e.g., chrome, ceramic). That is, the anilox member may have a rigid or conformable textured surface layer formed over a structural mounting layer that may be, for example, a solid cylindrical, ellipsoidal or oblong cylindrical core, or one or more structural layers over the core. The structural solid core may be rigid and conductive (e.g, aluminum, steel). In examples, a conductive mounting layer may surround the core under the textured surface layer. The core may be hollow to allow fluid therein.

In examples, the textured surface layer may be rigid or conformable (e.g., including silicone, plastic, rubber), and may be an electrical insulator. The textured surface may be formed of a relatively thin layer over the mounting layer, a thickness of the relatively thin layer being selected to balance fountain solution particle transfer, durability and manufacturability. The textured surface layer may include a belt or blanket that covers the mounting layer/core. The surface layer belt/blanket may sit fixed about the solid core, or may slide to rotate around the solid core. While not being limited to a particular theory, the dimples or anilox cells may be formed by embossment, etching, engraving, die casting, molding, laser ablation or other approaches understood by a skilled artisan. The dimples are not limited to a particular size and may have a diameter and/or depth of less than 1000 microns, 0.1-100 microns, 1-10 microns, 2-4 microns or about 3 microns. Further, the dimples are not limited by shape, and may be hemispherical, cylindrical, semi-ellipsoidal, prism shaped, cone shaped, trapezoid prism, hexagonal, pyramidal, tetrahedral, cuboidal, etc.

Referring to FIG. 2, solid particle aerosol development device 100 includes rotatable anilox member 102 having a pitted or textured surface layer 112 with anilox cells or dimples 114 configured to receive and carry fountain solution for transfer to the charge-retentive surface 22 shown as the stem of arrow 116 rotating in the direction of the arrow. A nip 118 is formed where the anilox member 102 contacts the metering member 104, which in FIG. 2 is shown as a roller 120 but may have or include other configurations (e.g., doctor blade) designed to meter fountain solution onto the textured surface layer 112. The textured surface layer 112 and roller 120 surface above the nip define a fountain solution reservoir 106 that may store fountain solution 38. Additional fountain solution 38 may be provided from a fountain supply source to the reservoir 106, as understood by a skilled artisan.

While not being limited to a particular theory, one of the anilox member 102 surface and the metering member 104 may have a high durometer to maintain rigidity in operation, while the other one of the anilox member surface and metering member may be conformable and resilient in operation to help reduce wear caused by interaction at the nip 118. In FIG. 2, the textured surface layer 112 may be compliant and also an electrical insulator (e.g., silicone), while the metering member is relatively hard with a higher durometer. The textured surface layer is wrapped about a structural mounting layer 122, which may be or be an outer part of the anilox member core 124. The structural mounting layer 122 and/or the core 124 may be conductive (e.g., aluminum, copper, steel) as a conductive member. In examples, the textured surface layer may be conductive and held at an electric potential relative (e.g., higher, lower, about the same) to an electrical potential of the electrostatic charged pattern.

In operation, anilox member 102 rotates (clockwise in the side view of FIG. 2) and the textured surface layer 112 is chilled to below the freezing point of the fountain solution 38. For example, if the fountain solution is D4, then the anilox member 102 surface is chilled to less than 17° C. The textured surface layer 112 may be chilled by flowing chilled fluid 130 inside the hollow anilox member core 124, as understood by a skilled artisan. Of course the approach to chilling the anilox member surface is not so limited as other known approaches exist, such as a cooler (not shown) outside the textured surface layer.

Chilling the textured surface layer 112 to below the freezing point of the fountain solution freezes fountain solution in contact with the textured surface, including fountain solution in the dimples 114. As the textured surface layer 112 rotates through the nip 118, the roller 120 removes excess fountain solution above lands of the textured surface layer between the dimples 114 from the pitted surface, resulting in a metered layer 126 of the fountain solution. The scope is not limited by the manner that the metered layer may be frozen into fountain solution particles. In examples, the fountain solution may freeze by contact with the dimpled surface into solid fountain solution particles. In examples the fountain solution may freeze while in the reservoir 106 before the nip 118 so the dimples 114 are filled with solid fountain solution particles as the dimpled surface rotates through the nip. Further to the examples, solid fountain solution in the reservoir 106 may be pressurized towards the nip so the dimples 114 are filed with the solid particles as the dimples rotate through the nip, as understood by a skilled artisan.

The particle charger 108 converts the fountain solution particles of the metered layer 126 into charged fountain solution particles. It is understood that the invention is not limited by the manner that the fountain solution particles are charged by the particle charger 108. In examples, the fountain solution particles may be charged by corona charging or discharge (FIG. 2) from a corotron, scorotron 132 (FIG. 2), or other conductor carrying a voltage as readily understood by a skilled artisan. In examples, the fountain solution particles may also be charged by charging the textured surface layer 112 (e.g., insulating surface) of the anilox member 102 before filling the dimples 114 with fountain solution. In examples, the particle charger 108 may convert the fountain solution stored in the fountain solution reservoir 106 into charged particles by injecting charge into the stored fountain solution that is metered into the charged solid particles, as understood by a skilled artisan.

The charged fountain solution particles are frozen and released from the anilox member dimples 114 downstream the nip 118 as charged solid fountain solution particles 128. The charged solid fountain solution particles 128 may be released by any of several approaches, including self-repulsion from centrifugal forces caused by the rotating anilox member, vibration, or applied electrostatic field/forces. In FIG. 2, the anilox member 102 is spatially separate from the charge retentive reimageable surface 22 of the rotating imaging member 16 by only a small gap (e.g., less than about 500 microns, about 5-200 microns, about 50-120 microns). Thus the charged solid fountain solution particles are released proximate the rotatable charge-retentive surface 22 and may resemble a fog of frozen solid fountain solution particles. As charged electrostatic image areas of the electrostatic charged pattern 34 pass below the anilox member 102, charged solid fountain solution particles 128 jump across and develops a latent image surface.

Where uncharged/discharged regions of the electrostatic charged pattern 34 pass, a weak field of opposite polarity exists which keeps the charged solid fountain solution particles 128 from being pulled to the image surface. The charged fountain solution particles may be charged opposite the charge of the electrostatic charged pattern 34, and are thus attracted to the electrostatic charged pattern to attach to the charge-retentive surface at the charged pattern and form the patterned fountain solution latent image 28. In other examples, the charged fountain solution particles may be charged the same as the charge of the electrostatic charged pattern and the weak field of opposite polarity attracts the charged particles to the charge-retentive surface at locations other than the electrostatic charged pattern to form a latent image as a negative of the charged pattern.

FIG. 3 depicts another example of a solid particle aerosol development device 150 substantially similar to the solid particle aerosol development device 100, with like referenced numerals designating similar or identical elements. Similar to the example shown in FIG. 2, anilox member 102 rotates (clockwise in the side view of FIG. 3) and the textured surface layer 112 is chilled to below the freezing point of the fountain solution 38. As the textured surface layer 112 rotates through the nip 118, the roller 120 removes excess fountain solution above lands of the textured surface layer between the dimples 114 from the pitted surface, resulting in a metered layer 126 of the fountain solution that freezes by contact with the dimpled surface into solid fountain solution particles. The particle charger 108 converts the fountain solution particles of the metered layer 126 into charged fountain solution particles that are frozen and released from the anilox member dimples 114 downstream the nip 118 as charged solid fountain solution particles 128.

In FIG. 3, the anilox member 102 is spatially separate from the charge retentive reimageable surface 22 of the rotating imaging member 16 by a gap relatively larger than the small gap depicted in FIG. 2. The charged solid fountain solution particles 128 in FIG. 3 are released further away from the rotatable charge-retentive surface 22 and may resemble a larger fog of frozen solid fountain solution particles. To help confine the fog of charged solid fountain solution particles 128, the solid particle aerosol development device 150 may include a fountain solution particle baffle 110 adjacent the anilox member 102 and extending about the charge-retentive surface 22 downstream the anilox member in the rotating direction of the imaging member. The charge retentive surface 22 and particle baffle 110 may define a particle flow channel 154 that confines the charged solid particles within the particle flow channel proximate the charge-retentive surface.

Carrier gas 156 (e.g., dry air, nitrogen) may flow from a gas source (e.g, gas tank, fan—not shown) into input port 152 upstream the anilox member 102 through the particle flow channel 154 to help carry the fog of charged solid fountain solution particles 128 over the charge retentive surface 22. A second baffle 158, which may be an extension of the particle baffle 110, may extend about the charge retentive surface 22 upstream the anilox member 102 to help direct the carrier gas to the particle flow channel. As the fog of charged solid fountain solution particles 128 drifts with the carrier gas 156, the particles may then attract to and attach to the charge-retentive surface, and form the patterned fountain solution latent image based on the electrostatically patterned target.

Slightly downstream the anilox member 102 an electrode 160 adjacent the particle baffle 110 to create an AC field 160 that causes the drifting charged solid fountain solution particles 128 to form a fluidized bed or cloud near the charge retentive surface 22. Charged regions of the electrostatic charged pattern 34 may then extract charged solid particles 128 to develop the fountain solution latent image 28. In examples the baffle may be conductive and/or have an electrode 160 on its surface. Further, in examples the AC field 160 may be DC or DC+AC. The DC may be between or about half way between charged and discharged voltages on the charged image and the AC may be centered on the DC.

FIG. 4 depicts another example of a solid particle aerosol development device 170 substantially similar to the solid particle aerosol development devices 100, 150, with like referenced numerals designating similar or identical elements. As noted above, one of the anilox member 102 surface and the metering member 104 may have a high durometer to maintain rigidity in operation, while the other one of the anilox member surface and metering member may be conformable and resilient in operation to help reduce wear caused by interaction at the nip 118. In FIG. 4, the textured surface layer 112 may be a textured belt 172 having a high durometer (e.g., metal, steel, aluminum) debossed with shallow dimples 114 (e.g., less than 20 microns, less than 7 microns, about 2 microns) and wrapped around a core 126 having an oval cylindrical shape. Here, the metering member 104 may be a doctor blade 176 made of a relatively softer and compliant material (e.g., silicone, plastic, rubber).

An oval cylindrical shaped anilox member may provide benefits over a circular cylindrical shape. As can be seen in FIG. 4, the metered layer of fountain solution 126 may remain in the dimples 114 for an extended time to freeze into solid particles before release from the textured surface layer 112. At the bottom of the belt 172, the radius of curvature is reduced and the dimple walls are flexed away from each other, thereby facilitating release of the charged solid fountain solution particles 128 as the dimples 114 deform. Further, the particle aerosol development device 170 can include an ultrasonic transducer 178 under the belt 172. The ultrasonic transducer 178 may transmit ultrasonic energy to the textured surface layer 112 to further assist release of the charged solid fountain solution particles 128 from the containing dimples. The transducer 178 is not limited to the example shown in FIG. 4 and may be used in other examples, including examples having cylindrical shaped anilox members as depicted in FIGS. 2 and 3.

In examples, the solid fountain solution aerosol particles have a narrow distribution of size and charge to mass ratio (C/M, also referred to herein as Q/m). Aerosols with higher/lower C/M would produce lower/higher fountain solution volumes, respectively, in the fountain solution latent image. Thus, by controlling the C/M and by controlling rotational speeds of the anilox member 102 and the imaging member 16, such as by the controller 70, the volume of fountain solution and thickness of the fountain solution latent image 28 may be controlled. The solid particles may have a diameter of around one (1) micron. As an example, a pixel of area 20×20 microns (corresponding to 1200 dpi imaging) and a target fountain solution thickness of around 200 nano-meters (nm) would need around 150 droplets/particles to provide the desired coverage. For the fountain solution patterning to yield 1200 dpi resolution, monodisperse solid particles about one micron +/−a factor of 2 in diameter with a uniform C/M are beneficial. The solid particle aerosol development devices 100, 150, 170 may be tuned to produce such a very narrow distribution of fountain solution solid particle diameters, for example, by manufacturing the textured surface layer 112 with like sized dimples 114. The aerosol development devices 100, 150, 170 may include a high voltage source (not shown) in communication with a conductive structural mounting layer 122 and/or anilox member core 126, but may charge the solid fountain solution particles by multiple ways including corona (ionized air), induction or conduction during or after solid particle generation.

As noted above, carrier gas 156 (e.g., nitrogen, pressurized air) may be supplied into input port 152 to help carry the fog of aerosol particles 36 through the particle flow channel 154 for delivery to the target (e.g., electrostatic charged pattern 34). The carrier gas 156 may be maintained below the freezing temperature of the fountain solution to maintain the charged solid fountain solution particles 128 frozen in the particle flow channel 154. Such frozen particles can be useful in controlling the capillary spreading forces of the fountain solution particles on a surface like the inking blanket 12 surface or the surface 22 of imaging member 16. If such particles remain frozen all the way to the fountain solution transfer nip 48 between the charge-retentive reimageable surface 22 and the inking blanket 12, nip pressure therebetween can act to melt the fountain solution particles and wet the inking blanket. In examples, a heat source may be used to melt the frozen fountain solution particles just before or after transfer to the inking blanket 12. In examples, the solid fountain solution particles forming the latent image 28 are melted to droplets before an inking.

Figure 5:
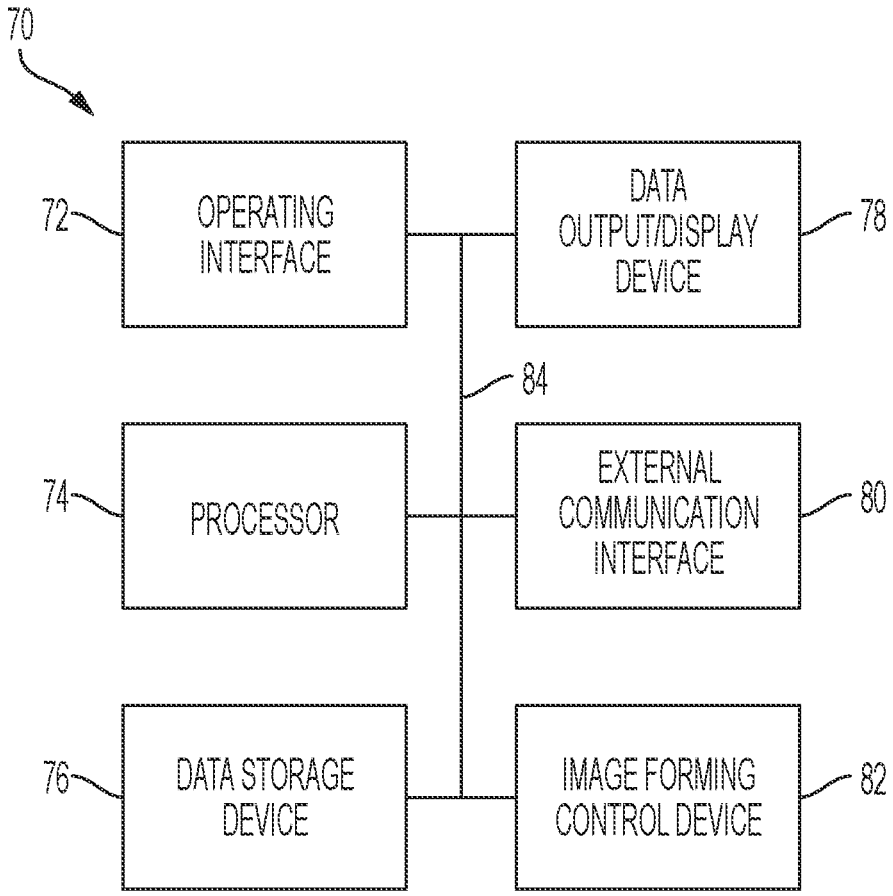
FIG. 5 is a block diagram of a controller with a processor for executing instructions to automatically control components of the digital image forming device and fountain solution solid particle aerosol development device depicted in FIGS. 1-4.

FIG. 5 illustrates a block diagram of the controller 70 for executing instructions to automatically control the ink-based digital image forming device 10, the fountain solution solid particle aerosol development devices 100, 150, 170 and components thereof. The exemplary controller 70 may provide input to or be a component of a controller for executing image formation methods in a system such as that depicted in FIGS. 1-4 and described in greater detail below in FIG. 6.

The exemplary controller 70 may include an operating interface 72 by which a user may communicate with the exemplary control system. The operating interface 72 may be a locally-accessible user interface associated with the digital image forming device 10 and fountain solution solid particle aerosol development devices 100, 150, 170. The operating interface 72 may be configured as one or more conventional mechanism common to controllers and/or computing devices that may permit a user to input information to the exemplary controller 70. The operating interface 72 may include, for example, a conventional keyboard, a touchscreen with "soft" buttons or with various components for use with a compatible stylus, a microphone by which a user may provide oral commands to the exemplary controller 70 to be "translated" by a voice recognition program, or other like device by which a user may communicate specific operating instructions to the exemplary controller. The operating interface 72 may be a part or a function of a graphical user interface (GUI) mounted on, integral to, or associated with, the digital image forming device 10 and fountain solution solid particle aerosol development devices 100, 150, 170 with which the exemplary controller 70 is associated.

The exemplary controller 70 may include one or more local processors 74 for individually operating the exemplary controller 70 and for carrying into effect control and operating functions for image formation onto a print substrate 20, including but not limited to forming an electrostatic charged pattern 34 on the charge retentive reimageable surface 22, forming charged solid fountain solution particles 128, depositing the charged particles onto the charge retentive reimageable surface 22 to form a fountain solution latent image 28, transferring the latent image from the imaging member 16 to an inking blanket 12 surface of an inked image transfer member 14, depositing a layer of ink over the latent image to form an ink image 18 and transferring the ink image from the inking blanket to print substrate 20. Processor(s) 74 may include at least one conventional processor or microprocessor that interprets and executes instructions to direct specific functioning of the exemplary controller 70, and control of the image forming process with the exemplary controller.

The exemplary controller 70 may include one or more data storage devices 76. Such data storage device(s) 76 may be used to store data or operating programs to be used by the exemplary controller 70, and specifically the processor(s) 74. Data storage device(s) 76 may be used to store information regarding, for example, a current image for patterning by the imaging station 24, desired and actual aerosol particle volume parameters, charge density of the charge-retentive surface 22, correction look-up tables, and digital image information with which the digital image forming device 10 and fountain solution solid particle aerosol development devices 100, 150, 170 are associated.

The data storage device(s) 76 may include a random access memory (RAM) or another type of dynamic storage device that is capable of storing updatable database information, and for separately storing instructions for execution of image forming operations by, for example, processor(s) 74. Data storage device(s) 76 may also include a read-only memory (ROM), which may include a conventional ROM device or another type of static storage device that stores static information and instructions for processor(s) 74. Further, the data storage device(s) 76 may be integral to the exemplary controller 70, or may be provided external to, and in wired or wireless communication with, the exemplary controller 70, including as cloud-based data storage components.

The data storage device(s) 76 may include non-transitory machine-readable storage medium to store the device queue manager logic persistently. While a non-transitory machine-readable storage medium is may be discussed as a single medium, the term "machine-readable storage medium" should be taken to include a single medium or multiple media (e.g., a centralized or distributed database, and/or associated caches and servers) that store one or more sets of instructions. The term "machine-readable storage medium" shall also be taken to include any medium that is capable of storing or encoding a set of instruction for execution by the controller 70 and that causes the digital image forming device 10 and fountain solution solid particle aerosol development devices 100, 150, 170 to perform any one or more of the methodologies of the present invention. The term "machine-readable storage medium" shall accordingly be taken to include, but not be limited to, solid-state memories, and optical and magnetic media.

The exemplary controller 70 may include at least one data output/display device 78, which may be configured as one or more conventional mechanisms that output information to a user, including, but not limited to, a display screen on a GUI of the digital image forming device 10, fountain solution solid particle aerosol development devices 100, 150, 170, and/or associated image forming devices with which the exemplary controller 70 may be associated. The data output/display device 78 may be used to indicate to a user a status of the digital image forming device 10 with which the exemplary controller 70 may be associated including an operation of one or more individually controlled components at one or more of a plurality of separate image processing stations or subsystems associated with the image forming device.

The exemplary controller 70 may include one or more separate external communication interfaces 80 by which the exemplary controller 70 may communicate with components that may be external to the exemplary control system such as a temperature sensor, printer or other image forming device. At least one of the external communication interfaces 80 may be configured as an input port to support connecting an external CAD/CAM device storing modeling information for execution of the control functions in the image formation operations. Any suitable data connection to provide wired or wireless communication between the exemplary controller 70 and external and/or associated components is contemplated to be encompassed by the depicted external communication interface 80.

The exemplary controller 70 may include an image forming control device 82 that may be used to control the image forming process to render ink images on the print substrate 20. For example, the image forming control device 82 may: control the imaging station 24 to form an electrostatic charged pattern 34 on the charge retentive reimageable surface 22, control the and fountain solution solid particle aerosol development devices 100, 150, 170 to form solid fountain solution aerosol particles, control the particle charger 108 to form charged solid fountain solution aerosol particles, and control anilox member 102 to deposit the charged solid fountain solution aerosol particles adjacent the charge retentive reimageable surface 22 of the imaging member 16 for attachment to an electrostatic charged patter 34 thereon. The image forming control device 82 may operate as a part or a function of the processor 74 coupled to one or more of the data storage devices 76, the digital image forming device 10 and fountain solution solid particle aerosol development devices 100, 150, 170, or may operate as a separate stand-alone component module or circuit in the exemplary controller 70.

All of the various components of the exemplary controller 70, as depicted in FIG. 5, may be connected internally, and to the digital image forming device 10, the fountain solution solid particle aerosol development devices 100, 150, 170, and/or components thereof, by one or more data/control busses 84. These data/control busses 84 may provide wired or wireless communication between the various components of the image forming device 10 and any associated image forming apparatus, whether all of those components are housed integrally in, or are otherwise external and connected to image forming devices with which the exemplary controller 70 may be associated.

It should be appreciated that, although depicted in FIG. 5 as an integral unit, the various disclosed elements of the exemplary controller 70 may be arranged in any combination of sub-systems as individual components or combinations of components, integral to a single unit, or external to, and in wired or wireless communication with the single unit of the exemplary control system. In other words, no specific configuration as an integral unit or as a support unit is to be implied by the depiction in FIG. 5. Further, although depicted as individual units for ease of understanding of the details provided in this disclosure regarding the exemplary controller 70, it should be understood that the described functions of any of the individually-depicted components, and particularly each of the depicted control devices, may be undertaken, for example, by one or more processors 74 connected to, and in communication with, one or more data storage device(s) 76.

Figure 6:
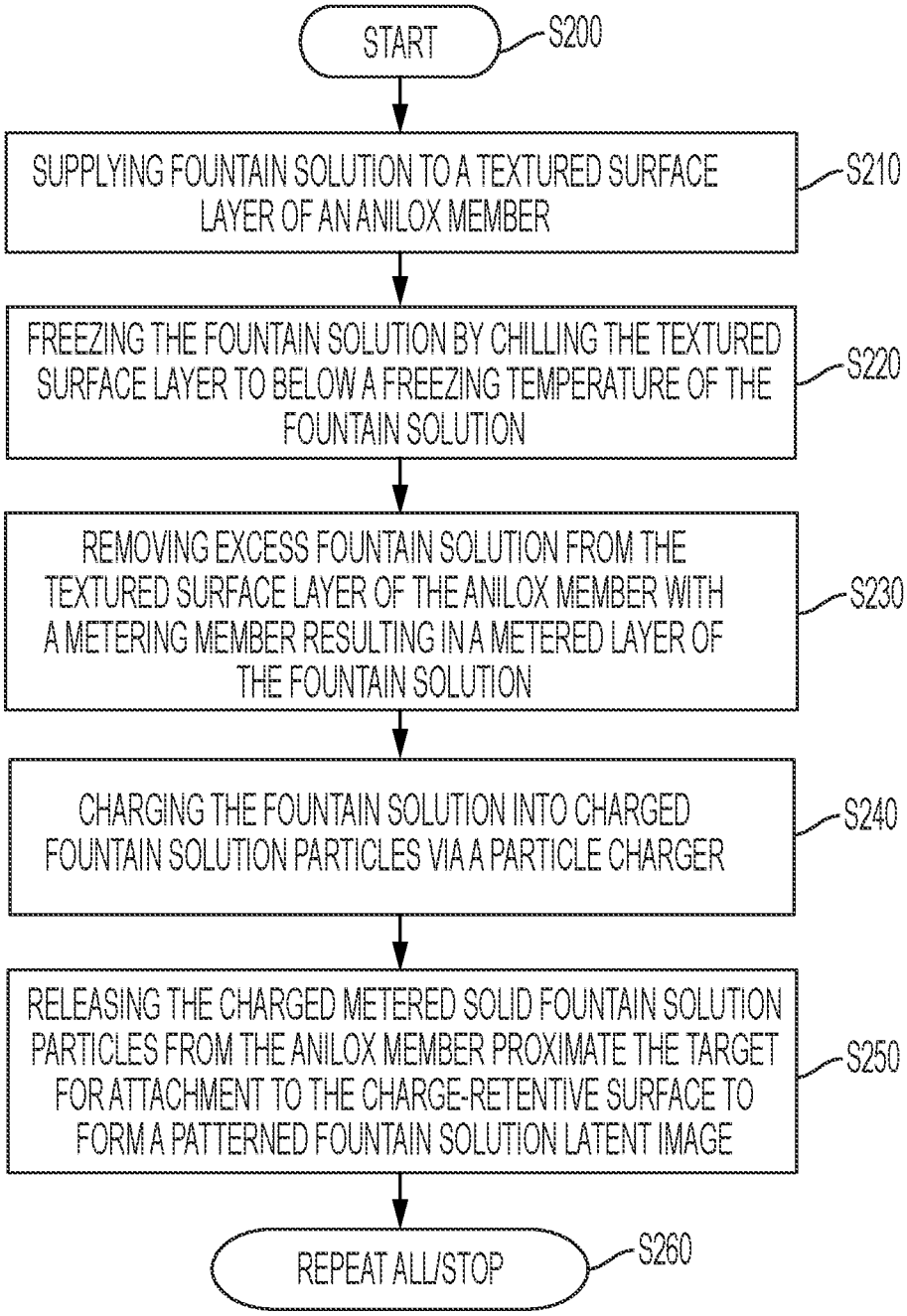
FIG. 6 is a flowchart depicting the operation of a fountain solution aerosol development device and digital image forming device in accordance with examples.

The disclosed embodiments may include an exemplary method for providing charged solid fountain solution particles to a target of the digital image forming device 10 from which an inked image may be printed. FIG. 6 illustrates a flowchart of such an exemplary method. As shown in FIG. 6, operation of the method commences at Step S200 and proceeds to Step S210.

At Step S210 fountain solution is supplied to a textured surface layer of an anilox member via a fountain solution reservoir. The fountain solution may be stored in a reservoir defined by the textured surface layer and metering member above a nip formed by contact therebetween. Additional fountain solution may be provided from a fountain supply source to the reservoir.

Operation of the method may proceed to Step S220, where a cooler proximate to the textured surface layer chills the textured surface layer to below a freezing temperature of the fountain solution to freeze the metered layer of fountain solution into solid fountain solution particles. The cooler may be in different configuration. For example, the cooler may be cold fluid 130 that flows inside the hollow anilox member core and chills the textured surface layer of the anilox member 124, as understood by a skilled artisan. Other examples may include a cooler outside the textured surface layer that cools the proximate fountain solution and textured surface layer.

Operation of the method may proceed to Step S230, where the metering member removes excess fountain solution material from the textured surface layer of the anilox member at the nip resulting in a metered layer of fountain solution on the textured surface layer downstream the nip. The metering member may remove excess fountain solution from the textured surface layer by rotating the anilox member through the nip. The metering member removes excess fountain solution above lands of the textured surface layer between dimples therein, resulting in the metered layer of the fountain solution.

Operation of the method may proceed to Step S240, where a particle charger converts the fountain solution in the metered layer into charged solid particles. The scope is not limited by the manner that the fountain solution particles are charged by the particle charger 108. In examples, the fountain solution particles may be charged by corona charging or discharge from a corotron, scorotron, or other conductor carrying a voltage as readily understood by a skilled artisan. In examples, the fountain solution particles may also be charged by charging the conductive structural mounting layer or core of the anilox member. In examples, the particle charger may convert the fountain solution stored in the fountain solution reservoir into charged particles by injecting charge into the stored fountain solution, as understood by a skilled artisan. The particle charger may charge the fountain solution particles by multiple ways including corona (ionized air), induction or conduction during or after solid particle generation.

Operation of the method may proceed to Step S250, where the charged solid particles are released from the anilox member proximate the rotatable imaging member charge-retentive surface. The solid particles may be released by any of several approaches, including self-repulsion from centrifugal forces caused by the rotating anilox member, vibration, or applied electrostatic field/forces. The released solid charged particles are attracted to the electrostatic charged pattern and may attach to the charge-retentive surface to form the patterned fountain solution latent image based on the electrostatic charged patterned. The latent image may be a positive image or negative image. Thus the fountain solution latent image may be used to reject inking or facilitate inking, as readily understood by a skilled artisan.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. For example, the fountain solution particle chilling and freezing may occur before or after metering, before or after charging, and before or after the fountain solution particles fill the dimples. Also, the fountain solution particles may be charged before or after metering, freezing or solid particle release. No particular order to the disclosed steps of the method is necessarily implied by the depiction in FIG. 6, and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

Those skilled in the art will appreciate that other embodiments of the disclosed subject matter may be practiced with many types of image forming elements common to offset inking system in many different configurations. For example, although digital lithographic systems and methods are shown in the discussed embodiments, the examples may apply to analog image forming systems and methods, including analog offset inking systems and methods. It should be understood that these are non-limiting examples of the variations that may be undertaken according to the disclosed schemes. In other words, no particular limiting configuration is to be implied from the above description and the accompanying drawings.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A charged fountain solution particle development device useful for printing with an ink-based digital image forming apparatus having a rotatable imaging member with a charge-retentive surface bearing an electrostatic charged pattern and a rotatable inkable blanket downstream the imaging member and having a surface in rolling communication with the charge-retentive surface, the rotatable inkable blanket configured to accept a patterned fountain solution latent image and transfer an ink image based on the patterned fountain solution latent image, the charged fountain solution particle development device comprising:

an anilox member having a textured surface layer with dimples configured to receive fountain solution in physical communication with the dimples and carry the fountain solution for transfer to the charge-retentive surface, the textured surface layer being a fountain solution freezing layer chilled to below a freezing temperature of the fountain solution to solidify or maintain solid the fountain solution carried by the textured surface layer as solid fountain solution particles;

a fountain solution reservoir having the fountain solution in physical communication with the textured surface layer to supply the fountain solution to the dimples of the anilox member;

a metering member in contact with the anilox member forming a nip therebetween, the metering member configured to remove excess fountain solution from the textured surface layer of the anilox member resulting in a metered layer of fountain solution; and a particle charger that converts the fountain solution carried by the textured surface layer of the anilox member into charged fountain solution, wherein the fountain solution carried by the dimples are released from the anilox member downstream the nip as charged solid particles proximate the rotatable imaging member charge-retentive surface, the released charged solid particles being attracted to the electrostatic charged pattern to attach to the charge-retentive surface and form the patterned fountain solution latent image based on the electrostatic charged patterned.

2. The device of claim 1, wherein the particle charger charges the fountain solution in contact with the anilox member.

3. The device of claim 1, wherein the particle charger charges the textured surface layer before the dimples receive the fountain solution.

4. The device of claim 1, wherein the particle charger converts the fountain solution stored in the fountain solution reservoir into charged particles by injecting charge into the fountain solution that is metered into the charged solid particles.

5. The device of claim 1, wherein the textured surface layer is an electrical insulator.

6. The device of claim 1, wherein the anilox member is spatially distanced from the imaging member charge-retentive surface leaving a gap with a physical and liquid disconnect therebetween.

7. The device of claim 1, wherein the anilox member is charged opposite the charged solid particles.

8. The device of claim 1, wherein the fountain solution reservoir is defined by the anilox member textured surface layer and the metering member.

9. The device of claim 1, wherein the metering member includes at least one of a roller and a doctor blade in contact with the anilox member to form a nip therebetween.

10. The device of claim 1, the anilox member further comprising a conductive member under the textured surface layer, wherein the particle charger converts the fountain solution of the metered layer into the charged solid particles via the conductive member opposite the electrostatic charged pattern.

11. The device of claim 1, wherein the textured surface layer is conductive and held at an electric potential relative to an electrical potential of the electrostatic charged pattern.

12. The device of claim 1, further comprising a fountain solution particle baffle adjacent the anilox member and extending about the charge-retentive surface downstream the anilox member in a rotating direction of the imaging member defining a particle flow channel with the charge-retentive surface to confine the charged solid particles within the particle flow channel proximate the rotatable imaging member charge-retentive surface for attraction to the electrostatic charged pattern to attach to the charge-retentive surface and form the patterned fountain solution latent image based on the electrostatically patterned target.

13. The device of claim 12, further comprising an electrode adjacent the fountain solution particle baffle to create a DC+AC field that causes the charged solid particles to form a charged fountain solution cloud in the particle flow channel for attraction to the electrostatic charged pattern and attachment to the charge-retentive surface to form the patterned fountain solution latent image.

14. The device of claim 1, wherein the anilox member includes a flexible anilox belt having the textured surface layer with the dimples, the flexible anilox belt shaped with a radius of curvature reduced proximate the charge-retentive surface with walls of the dimples flexed away from each other to facilitate the release of the charged solid particles from the anilox member.

15. The device of claim 1, further comprising an ultrasonic transducer in the anilox member under the dimples surface layer to transmit ultrasound to the textured surface layer and facilitate the release of the charged solid particles from the anilox member.

16. A fountain solution particle development device for delivering charged fountain solution particles onto a target having a charge-retentive surface bearing an electrostatic charged pattern thereon, the development device comprising:

an anilox member having a textured surface layer with dimples configured to receive and carry fountain solution for transfer to the charge-retentive surface;

a fountain solution reservoir in liquid communication with the anilox member to supply the fountain solution to the textured dimples of the anilox member;

a cooler proximate to the textured surface layer, the cooler configured to chill the textured surface layer to below a freezing temperature of the fountain solution to solidify or maintain solid the fountain solution adjacent the dimples;

a metering member in contact with the anilox member forming a nip therebetween, the metering member configured to remove excess fountain solution from the textured surface layer of the anilox member resulting in a metered layer of fountain solution particles on the textured surface layer; and a particle charger adjacent the anilox member that drives a flux of ions through the solid and metered fountain solution particles to form charged solid fountain solution particles, wherein the charged solid fountain solution particles are released from the anilox member proximate the target and are attracted to the electrostatic charged pattern to attach to the charge-retentive surface and form a patterned fountain solution latent image.

17. A method for delivering charged solid fountain solution particles onto a target having a charge-retentive surface bearing an electrostatic charged pattern thereon, comprising:

a) supplying fountain solution to a fountain solution reservoir in communication with a textured surface layer of an anilox member, the textured surface layer having dimples configured to receive and carry fountain solution;

b) freezing the fountain solution adjacent the textured surface layer into solid fountain solution particles by chilling the textured surface layer to below a freezing temperature of the fountain solution;

c) removing excess fountain solution from the textured surface layer of the anilox member resulting in a metered layer of fountain solution on the textured surface layer with a metering member in contact with the anilox member forming a nip therebetween;

d) charging the fountain solution of the metered layer into charged solid particles via a particle charger adjacent the anilox member; and e) releasing the charged solid particles from the anilox member proximate the target for attachment to the charge-retentive surface to form a patterned fountain solution latent image based on the electrostatic charged patterned.

18. The method of claim 17, further comprising forming the electrostatic charged pattern on the charge-retentive surface with an image forming unit adjacent the charge-retentive surface.

19. The method of claim 17, further comprising confining the charged solid particles within a fountain solution particle baffle adjacent the anilox member that extends about the charge-retentive surface downstream the anilox member, the fountain solution particle baffle defining a particle flow channel proximate the charge-retentive surface for attraction of the charged solid particles in the particle flow channel to the electrostatic charged pattern and attachment to the charge-retentive surface.

20. The method of claim 17, the step b) further comprising freezing the fountain solution adjacent the textured surface layer before the nip and filling the dimples with solid fountain solution particles as the dimpled surface rotates through the nip.

* * * * *